United States Patent [19]

Van Wagoner

[11] 4,021,981

[45] May 10, 1977

[54] INSULATED WATER IMPERMEABLE ROOFING SYSTEM

[75] Inventor: John D. Van Wagoner, McLean, Va.

[73] Assignee: Robert M. Barlow, Fairfax, Va. ; a part interest

[22] Filed: Mar. 5, 1976

[21] Appl. No.: 664,080

Related U.S. Application Data

[62] Division of Ser. No. 555,596, March 5, 1975, Pat. No. 3,971,184.

[52] U.S. Cl. ..... 52/309.13; 52/90; 52/408; 52/746; 156/71

[51] Int. Cl.[2] ..... E04D 1/28

[58] Field of Search ..... 52/90, 309, 173, 384, 52/385, 390–392, 393, 403, 408, 411–413, 613, 622, 744, 745, 746, 747; 156/71

[56] References Cited

UNITED STATES PATENTS

| | | | |
|---|---|---|---|
| 3,121,649 | 2/1964 | Oliver | 52/746 |
| 3,713,263 | 1/1973 | Mullen | 52/403 |
| 3,903,587 | 9/1975 | Boiardi | 52/744 X |
| 3,958,373 | 5/1976 | Stewart et al. | 52/309 |
| 3,969,851 | 7/1976 | Whitacre | 52/746 X |

*Primary Examiner*—J. Karl Bell

*Attorney, Agent, or Firm*—Kile, Gholz, Bernstein & Georges

[57] ABSTRACT

An insulated, water impermeable roofing system and a method for installing said system for insulating the interior of a building from ambient thermal cycling and for insuring water impermeable integrity of a roof portion of the building.

The roof system includes an array of factory assembled, laminar roofing panels self bonded to a roof deck. Each panel includes a water and vapor impermeable membrane and an insulation course coextensively overlying said membrane. The laminar roofing panels are mutually juxtaposed but laterally spaced from one another to provide a peripheral expansion zone which is filled with a water and vapor impermeable compound. The compound is plastic and self-adherent under normal ambient temperatures and therefore operably bonds to the roof deck between adjacent laminar roofing panels as well as to the water and vapor impermeable membrane. The expansion zone compound in combination with the panel membrane forms a monolithic water and vapor impermeable barrier across the entire roof deck. Concomitantly the compound forms a plastic expansion joint about the peripheral edges of each of said laminar roofing panels.

The method for installing an insulated, water impermeable roofing system of the type previously described includes the step of preparing a roof substructure or deck to be fitted with an insulated water impermeable covering. Next the method comprises the steps of peeling a release film from factory assembled roofing panels and positioning a plurality of the roofing panels upon a roof deck with a self-adhering surface directly bonded to the deck. Once the panels are in position the installation is culminated by plastic, self-adherent compound into expansion zones around each panel to form a monolithic water and vapor impermeable barrier across the roof substructure and concomitantly to form a plastic expansion joint about the peripheral edges of the laminar roofing panels.

11 Claims, 7 Drawing Figures

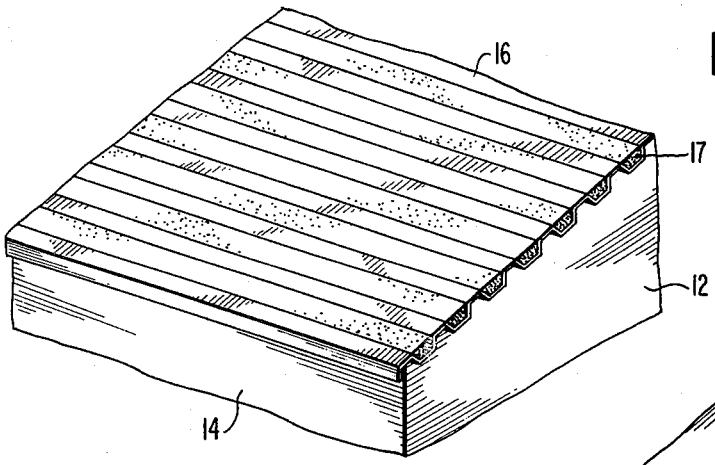
FIG. 4
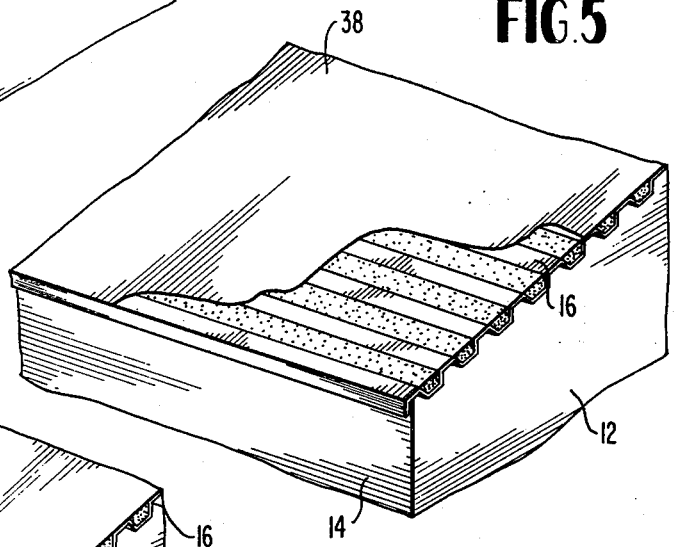
FIG. 5
FIG. 6
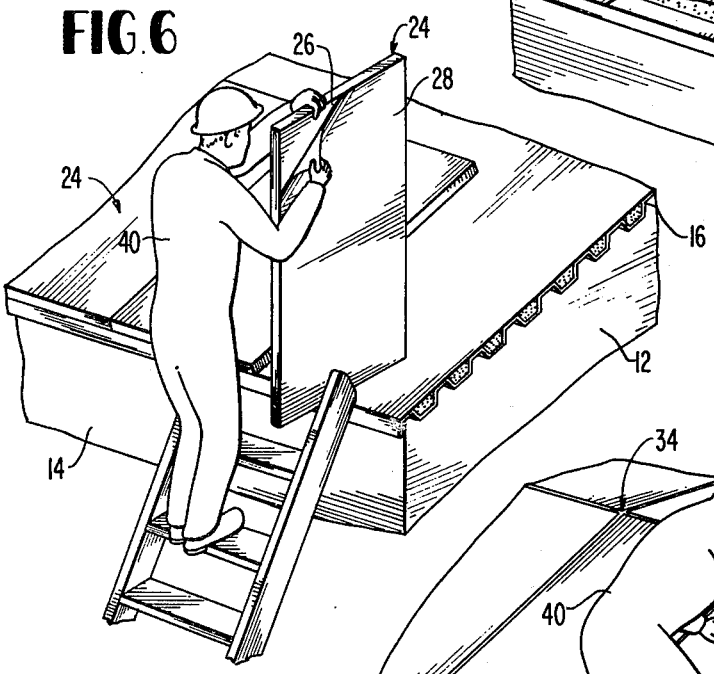
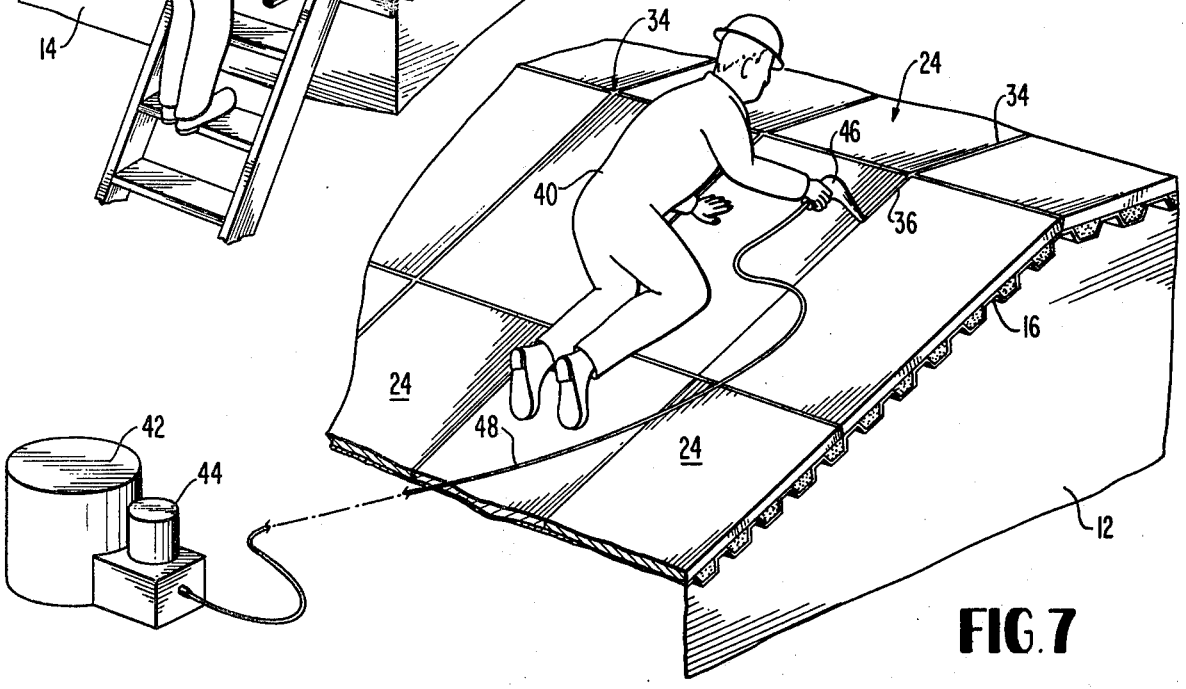
FIG. 7

INSULATED WATER IMPERMEABLE ROOFING SYSTEM

This is a division of application Ser. No. 555,596 filed March 5, 1975 now U.S. Pat. No. 3,971,184.

BACKGROUND OF THE INVENTION

This invention relates to an improved roofing system. More particularly, this invention relates to an insulated, water impermeable roofing system for insulating the interior of a building from ambient thermal cycling and for insuring water impermeable integrity of a roof portion of the building.

The basic concept of a roof is to act in cooperation with generally vertical walls to form an enclosed space which may be isolated from an ambient environment and thus may be regulated in accordance with intended utilization.

A threshold or common denominator of almost all controlled environments is to maintain the enclosure in essentially a water tight or dry condition. Accordingly over the years the roofing industry, and particularly the commercial roofing industry, has attempted to maintain a water tight or water impermeable roof condition by building a water impermeable barrier, in situ, upon a roof substructure or deck. Such a water barrier has typically assumed the configuration of a laminar composite comprising a plurality of felt layers with intercalated courses of bituminous composition.

More particularly the bituminous compound typically arrives at a job site in solid cylinders. The cylinders are melted in a heater and the hot liquid is then carried in buckets to the roof deck where it is mopped onto a previously prepared roof substructure. A roll of felt paper is then carried to the roof and unrolled upon the hot bituminous compound which binds the felt to the roof deck. Three or more courses are then built up over the entire roof structure. The job is finished with a layer of topping gravel. The gravel weights down the felt courses and also serves as a shield to minimize ultra-violet degradation of the felt and bituminous membrane.

Although water impermeable roofing membranes, as previously noted, have been widely utilized in the commercial roofing industry substantial disadvantages have been occasioned. In this connection, elevated roof temperatures vaporize volatile components in the bituminous compound. The compound then tends to harden and crack in a checkered or "allegator" array. Moreover as the bituminous compound becomes hot during the summer months the overlay course of gravel tends to sink into the membrane. Further, prior roofing systems often developed vapor blisters, splitting or ridging.

The above factors each tended to create water seepage difficulties which ultimately rendered the roof unsuitable for its intended purpose.

In addition to water impermeability considerations conventional environmental control criteria dictates internal isolation from thermal cycling which takes place at the exterior surface of a roof. More particularly the exterior surface of a roof may experience temperatures during midsummer as high as 180° while a winter cold front may drop the temperature to as low as 20° or 30° below zero. The interior surface of the roof, however, should optimally be maintained at a desired interior temperature which typically is 65° to 75° Fahrenheit.

In order to provide thermal protection an intitial practice entailed lining the interior surface of the roof with an insulation composition such as sprayed or layered glass fibers, fiberboard, plastic foams and the like. While such insulation facilitated the thermal cycling problem it severely accentuated the previously outlined difficulties occurring with the felt and bituminous water barrier by, in essence, isolating the barrier from the relatively stable interior temperature of the building structure. Accordingly it was not uncommon for roof membranes to require considerable attention and in some instances periodic replacement.

A significant advance in the roofing art occurred in the relatively recent past when it was determined that an insulation course could be effectively installed exterior of the felt and bituminous water barrier. The thus positioned insulation still provided a building with isolation from thermal gradients as desired while at the same time protected the felt and bituminous waterproofing barrier.

An insulated roof membrane assembly which has attained at least a degree of industry recognition comprises a water barrier of felt and bituminous lamination which is built up, in situ, in a manner as previously discussed. A hot course of bituminous compound is then mopped upon the final layer of felt and generally rectangular panels of polystyrene are laid directly upon the hot bituminous compound. The polystyrene insulating members are mutually abutted against each other, however, a peripheral fissure inherently exists between the members and permits water to drain thereinto and away from the upper surface of the roofing insulation. A relatively heavy course of aggregate is loosely applied directly upon the upper surface of the thermal insulating members to hold the members in place and isolate the insulation surface from ultra-violet degradation.

While such a system, as previously noted, has achieved at least a degree of industry recognition and utilization, room for significant improvement remains.

In this regard, an insulated roof membrane assembly as described in the proceeding requres on site fabrication which is laborious, hot and extremely odorous. Accordingly it is sometimes difficult to obtain and retain qualified personnel to install the system. Moreover the loose gravel which is applied directly to the insulation course in order to maintain it in place is typically deposited at a rate of 1,000 pounds per square foot or more. The roof deck must therefore be designed to support a considerable amount of weight. Still further, since the aggregate is applied in a loose condition, it is not recommended to apply the foregoing roofing system to a roof having a pitch any greater than 2/12. Additionally, during rains, water collects in the insulation fissures which drains along the waterproofing membrane and serves to strikingly reduce the insulation effectiveness. Yet further, because of the exposed character of the insulation panels the types of insulations which may be utilized are limited to only those which will not be damaged during installation by a layer of hot bitumen and which are relatively incapable of absorbing water and/or are not water degradable. Moreover, because water is designed to channel within the fissures if the weight aggregate is in some manner displaced, the individual panels are subject to floatation. Additionally, it is difficult or cumbersome to roll or push equipment upon the loose aggregate and thus it is somewhat difficult to utilize the roof as a service entrance. Still further, it is difficult, if not impossible, to apply the above noted insulated roof membrane to all the different varieties of roof deck structures which now exist in the roofing industry, such as, for example, corregated metal roofs.

The problems suggested in the proceeding are not intended to be exhaustive, but rather are among many which may tend to reduce the effectiveness of prior insulated roofing membrane assemblies. Other noteworthy problems may also exist; however, those presented above should be sufficient to demonstrate that insulated, water impermeable roofing systems appearing in the prior art have not been altogether satisfactory.

OBJECTS AND SUMMARY OF THE INVENTION

Objects

It is, therefore, a general object of the invention to provide an insulated, water impermeable roofing system which will obviate or minimize problems of the type previously described.

It is a particular object of the invention to provide a novel insulated, water impermeable roofing system which is factory assembled and thus minimizes the amount of labor and effort required for installation at a job site.

It is another object of the invention to provide an insulated, water impermeable roofing system which is light-weight and is easily handled and installed as well as reduces the load bearing properties upon the underlying roofing deck.

It is yet another object of the invention to provide a novel insulated, water impermeable roofing system which is suitable to utilize a wide variety of insulation materials and provide a maximum degree of thermal gradient control.

It is still another object of the invention to provide a novel insulated, water impermeable roofing system which is immune to insulation saturation and maintains its full insulating properties even during a rainstorm.

It is a further object of the invention to provide a novel insulated, water impermeable roofing system which is self-adherent and can be applied to all types of roofing decks and may further be applied to decks having an appreciable pitch.

It is yet a further object of the invention to provide a novel insulated, water impermeable roofing system which is highly reflective and possesses a very low heat absorption factor as well as provides protection from ultra-violet degradation.

It is still a further object of the invention to provide a novel insulated, water impermeable roofing system which is easily assembled and installed at a job site and which, when installed, presents a substantially planar firm exterior surface which facilitates mobility over the surface when required.

It is yet still a further object of the invention to provide a novel insulated, water impermeable roofing system which is economical to install and maintain and which is operable to accomodate thermal expansion and contraction without jeopardizing the water impermeable integrity of the system.

One preferred embodiment of the invention which is intended to accomplish at least some of the foregoing objects comprises an insulated, water impermeable roofing system made up of an array of factory assembled, laminar roofing panels which are self-bonded to a substructure or deck of a building roof. Each panel includes a water and vapor impermeable membrane and an insulation course coextensively overlying said membrane. The laminar roofing panels are mutually juxtaposed, but laterally spaced from one another to provide a peripheral expansion zone which is filled with a water and vapor impermeable compound. The filler compound is plastic and self-adherent under normal ambient temperatures and therefore bonds directly to the roof deck between adjacent laminar roofing panels as well as the peripheral edges of the water and vapor impermeable membranes of each panel to form a monolithic water and vapor impermeable barrier across the entire roof deck and concomitantly to form a plastic expansion joint about the peripheral edges of each of said laminar roofing panels.

The method for fabricating an insulated water impermeable roofing system according to a preferred embodiment of the invention includes the steps of preparing a roof deck to be fitted with an insulated water impermeable covering, and peeling a release film from factory manufactured laminar roofing panels. The next step comprises positioning a plurality of the roofing panels upon the roof deck with a self-adhering surface of each panel directly bonded to the roof deck and injecting a plastic, self-adherent compound into expansion zones about each panel to form a monolithic water and vapor impermeable barrier across the roof substructure.

In describing the invention the term roofing system has been used in particular relation to the uppermost portion of a building. It is fully intended, however, that this term also encompasses other roof-like portions of a building complex such as a plaza deck and the like.

THE DRAWINGS

Other objects and advantages of the present invention will become apparent from the following detailed description of a preferred embodiment taken in conjunction with the accompanying drawings, wherein.

Figure 3:
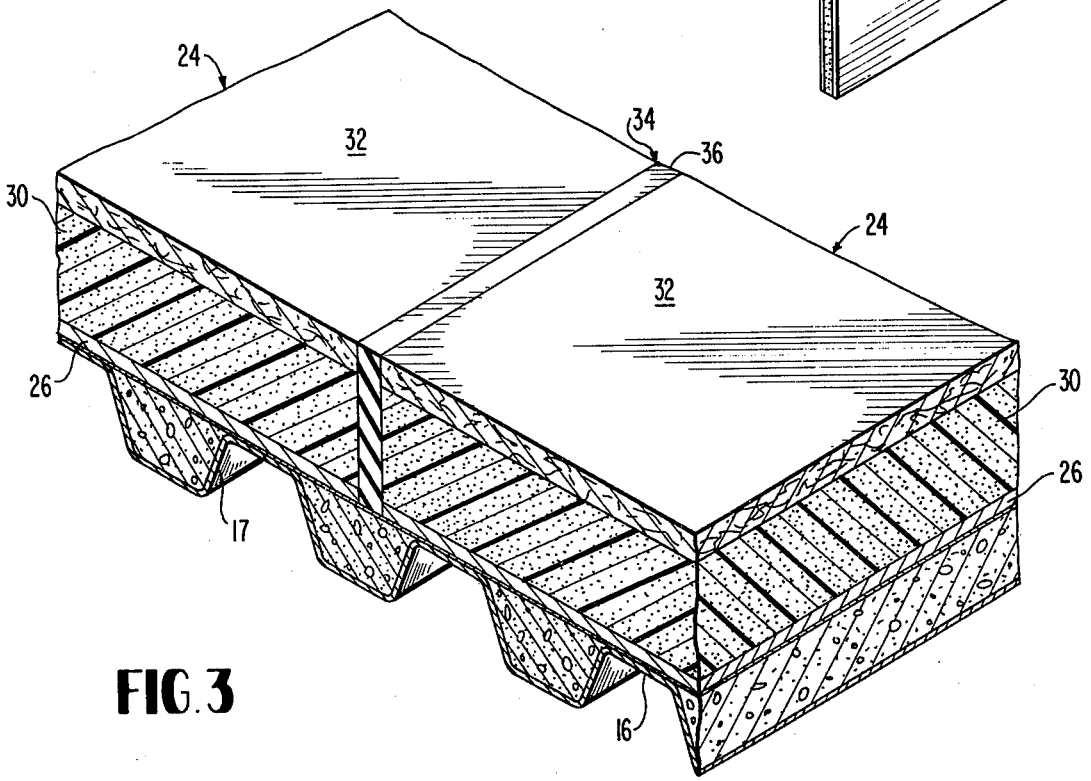

FIG. 3 discloses an axonometric, cross-sectional detailed view of a pair of insulated, water impermeable roofing panels positioned upon a corrugated, metal roofing deck and including an expansion joint between the juxtaposed panels; and FIGS. 4–7 schematically disclose a typical sequence of installation of a roofing system according to the invention wherein:

a. FIG. 4 discloses a segment of a corrugated metal roofing deck of the type which may receive the insulated, water impermeable roofing panels in accordance with the subject invention;

b. FIG. 5 discloses the application of an optional coating or film or primer material to the uppermost surface of the roof deck;

c. FIG. 6 discloses a roofer carrying an insulated, water impermeable roofing panel up to the roof deck and peeling away a release sheet which is adhered to the plastic water and vapor impermeable membrane of the roofing panel, and d. FIG. 7 discloses a roofer finishing the job by injecting a plastic, self-adherent compound into expansion joints around juxtaposed roofing panels.

DETAILED DESCRIPTION

Context of the Invention

Figure 1:
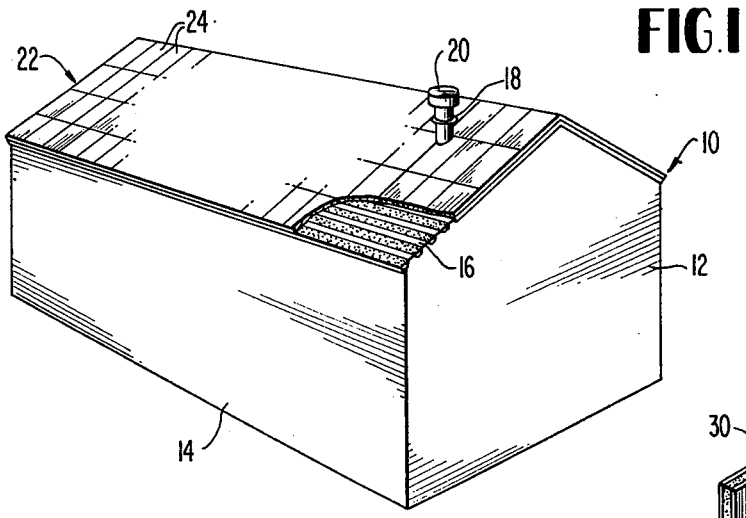
FIG. 1 is an axonometric view of a bulding or enclosure including a sloping roof deck with an array of insulated, water impermeable roofing panels applied to the upper surface of the roofing deck.
Figure 2:
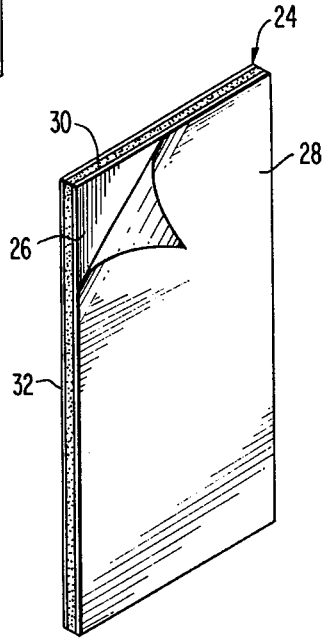
FIG. 2 is an axonometric view of an individual insulated, water impermeable roofing panel including a peel-away release film which is fixed to an outward surface of a plastic, self-adherent water and vapor impermeable membrane.

Referring now particularly to FIG. 1, an axonometric view can be seen of a general operative environment of the invention. In this regard, a conventional frame building structure 10 is depicted having an end wall 12 and a side wall 14. The building is peripherally enclosed by opposing end and side walls, not shown. In order to complete the enclosure defined by the end and side walls, a roofing substructure or deck 16 is fixedly connected to the upper edge of the walls.

As depicted, the roofing deck 16 is provided with a conventional pitch to facilitate water shedding. Although not specifically depicted in FIG. 1, a large percentage of commmercial buildings such as hospitals, schools, factories, stores and the like, are designed with a substantially horizontal roofing surface. The subject invention also finds particular utility with such horizontal surfaces.

The roof substructure or deck 16 as specifically depicted, note particularly FIG. 3, comprises a corregated metal surface 17 wherein the upwardly exposed undulations are filled with an insulation material such as, for example, insulating concrete. The corregated metal roofing deck is depicted because it is one of the most difficult surfaces to cover with a water tight membrane. Accordingly the versatility of the subject invention is thereby illustrated. It should be appreciated, however, that the invention is not limited to roofing decks of corregated metal but rather finds application with all conventional roof decks. Major categories of deck materials include wood, fiberboard, concrete, precast concrete, light-weight concrete, insulating concrete, steel decks, and composition roof panels.

Conventional building structures also are fashioned with a number of openings through the roof deck to accomodate chimneys, vents, etc. In FIG. 1 a vent 18 is depicted having an inverted cap 20. While a single vent is specifically illustrated as previously suggested, it will be appreciated by those skilled in the art that a plurality of such vents or the like may be encountered in a conventional commercial building roof deck. It will also be recognized by these skilled in the art that it is difficult and time-consuming to lay up felt and bituminous layers around such obstructions. The subject invention, inter alia, obviates such difficulties.

In accordance with the subject invention, the roof deck or substructure 16 if fitted with an array 22 of insulated, water impermeable roofing panels 24 which are factory assembled as more fully described hereinafter.

Insulated Water Impermeable Panel

Each insulated, water impermeable roofing panel 24 comprises an initial water and vapor impermeable membrane 26. In generic terms, this membrane is composed of a plastic composition which is self-adherent under normal ambient temperature conditions and thus is suitable to adhere directly to a conventional roof deck 16.

In order to facilitate storage and handling the outward surface of the plastic, self-adherent membrane 26 is overlaid with a release membrane 28 which may comprise a plastic sheet or paper composition well known to those skilled in the art.

An insulation course 30 is coextensively juxtaposed against the water and vapor impermeable membrane 26 and is fixedly bonded to the outward surface thereof. This insulation course 30 functions to isolate the water and vapor impermeable membrane as well as the roof deck from ambient thermal cycling.

The factory assembled, insulated, water impermeable roofing panel is finished with an optional, but preferred, protective course 32 coextensively juxtaposed against and bonded directly to the outer surface of the insulated course 30.

The laminated panel 24, comprising a water and vapor impermeable layer 26, a protective course 32, and an intercalated insulation layer 30, is factory assembled into easily handled shapes such as rectangles of approximately three by 4 feet in dimension which weight a total of approximately 25 pounds. The release paper 28 is applied during manufacture and the panels are thus facilely stacked and stored until ready for application.

Upon delivery to a job site a roofing contractor is able to rapidly and efficiently install a roofing system merely by removing the release paper 28 and laying the preassembled panels directly onto a roof deck 16 in an regular rectangular matrix or a staggered array as desired.

The individual factory assembled panels 24 are positioned such that an expansion zone 34 is created between closely juxtaposed panels about the peripheral edges thereof. The expansion zone is preferably one eighth to one half inch in width to accomodate lateral movement of the insulation panels.

In a preferred embodiment, once the panels 24 are applied to the roofing deck 16, the peripheral expansion zone 34 is filled with a plastic, self-adherent compound 36, which typically is similar to the water and vapor impermeable membrane 26. Accordingly, it will be appreciated that once the sealing compound 36 is injected into the expansion zone, a monolithic water impermeable membrane is created which extends throughout the extent of the roofing deck.

While the water and vapor impermeable membrane 26 is specifically selected to prevent both water and vapor from passing in either direction therethrough, it will be recognized by those skilled in the art, that where buildings are designed with a high humidity requirement, water vapor may permeate any weak portions of the membrane 26. In a similar connection, it is possible that during factory assembly water vapor may be entrapped within the intercalated insulation course 30 or water may have seeped into the insulation during storage and/or during application.

In order to minimize the possibility of warping, hooving or blistering the courses 26, 30 and 32 have a progressively increasing water vapor permebility so that water vapor which either penetrates the membrane 26 or which is entrapped within the insulation course 30 is permitted to escape to the atmosphere without damaging the panel.

Having now described in detail a factory assembled, insulated, water impermeable roofing panel in accordance with a preferred embodiment of the invention, it may be useful to consider presently preferred composi-tions or compounds for each course and a most preferred composition.

In this regard, the water and vapor impermeable membrane 26 must possess the instantly mentioned properties along with a plasticity and adhesion capability accomodating minor irregularities in the upper surface of the roof deck and for bonding the panel directly to the deck. Materials which find particular utility include petroleum based, bituminous resin, plasticized with high molecular weight polymeric additives, or unvulcanized synthetic rubber, neoprene or butyl rubber compositions, polyurethane elastomeric materials, polysulphide elastomeric materials, silicone elastomeric materials, acrylic elastomeric materials, and polyethylene or polyvinyl chloride compositions. The most preferred composition for the water and vapor impermeable membrane 26 is a petroleum based, bituminous resin, plasticized with high molecular weight polymeric additives, or unvulcanized synthetic rubber.

The insulation course 30 intercalated between the water and vapor impermeable membrane 26 and the protective layer 32 may be composed of conventional closed cell insulating material. While it is preferred, it is not absolutely necessary that this course be water impermeable. Such an insulation composition may be selected from a polystyrene family of expanded foams, polyurethane or polyvinylflouride family of foams, foam glass or glass beads, insulating concrete or bituminous blocks. While it is anticipated that the foregoing materials are operative, it has been found that polyurethane expanded foam is the most preferred and possesses markedly superior insulating properties to other known materials.

Turning now to the outer, optional, protective course 32 a basic criteria is that the composition must be a fire retardant material that is resistant to normal environmenal factors such as ultra-violet and/or ozone degradation, temperature cycling and high winds. Moreover, a further requirement is that the outer course should be water but not vapor impermeable. Compositions which fined utility include concrete and mortar containing water proofing admixtures, various liquid sheet-applied fire retardant elastomeric or epoxy coatings and various clay, tile, or cement asbestos board panels or blocks. While the foregoing materials may be utilized, a preferred composition comprises a fiberglass reinforced surface bonding cement containing an acrylic polymer emulsion additive.

Method of Installing a Roofing System

With the reader's attention now invited to the second sheet of the drawings and particularly FIGS. 4–7 thereof, there will be seen a sequential depiction of a method for installing an insulated, water impermeable roofing system upon a roofing deck in accordance with a preferred embodiment of the invention.

FIG. 4 discloses a roofing deck 16 comprising a metallic channel configuration wherein the upwardly opening channels are filled with a concrete compositon for weight and insulation purposes. As previously mentioned, the roofing deck may commercially comprise sixty to seventy varieties of designs, however, one of the most difficult to cover is a corregated metal roof deck which has a significant degree of pitch, such as depicted in FIG. 4. Accordingly, this most difficult roofing surface is selected to demonstrate the wide ranging application of the subject roofing system to the roofing industry. All detail or preparaton work is performed upon the open roofing deck 16 such as repairing and/or sealing cracks, penetrations, terminations, etc.

Referring to FIG. 5, an optional primer coat 38 may next be applied to the roofing deck 16 to enhance the adhesive quality of the factory assembled panels to the deck structure. In this regard, the primer is selected from any penetrating material which is compatible with the water and vapor impermeable membrane 26 and is capable of enhancing the adhesion of the membrane to the deck. Materials which find utility are synthetic rubber and resin based formulas in an organic solvent system, bituminous cut-back material, acrylic-based compounds and polyurethane-based compounds.

Continuing to FIG. 6, it is disclosed that a roofer 40 carries panels to the deck surface 16, and peels away the release paper 28 to expose the plastic, self-adherent, tacky, water and vapor impermeable membrane 26. The individual panels 24 are then laid up in a rectangular matrix or staggered array, as previously noted. The panels are positioned in close lateral juxtaposition, but mutally peripherally spaced, to form an expansion zone 34 of about one eighth to one half inch about each panel 24.

Turning now to FIG. 7, it will be seen that the roofer 40 next ascends the laid-up array of factory assembled panels 24.

Utilizing an injection apparatus, including a ground reservoir 42, a pump 44 and a hand injection nozzle 46, the roofer injects a plastic, self-adherent compound 36 into the expansion zone 34. The compound bonds to the roof deck 16, the peripheral edges of the water and vapor impermeable membrane and also the peripheral edges of the insulation and protective courses 30 and 32 of the roofing panel.

Upon injection of the water and vapor impermeable compound up to the level of the outer surface of the wear course 32, a monolithic water and vapor impermeable barrier is formed across the entire roof substructure or deck and concomitantly a plastic expansion joint is fashioned about the peripheral edges of each of the laminar roofing panels 24.

Having described in detail a preferred embodiment of the invention and before continuing with the claim portion of the specification, it may be useful to briefly set forth some of the major advantage of the invention.

SUMMARY OF MAJOR ADVANTAGES OF THE INVENTION

In describing an insulated, water impermeable, roofing system in accordance with a preferred embodiment of the invention those skilled in the art will recognize several advantages which singularly distinguish the subject invention from the heretofore known prior art.

A particular advantage of the subject invention is the provision of a factory assembled roofing panel which may be facilely stored and transported and applied by unskilled laborers at a construction site. In this connection, in prior known roofing systems, it was necessary to fabricate or build up a plurality of layers of felt and bituminous coats on the roofing deck. This job was particularly laborious, hot and extremely odorous. With the subject insulated and water impermeable roofing assembly all a roofer is required to do is peel away a release strip, position the panel in place and seal the expansion joint with a hand-operated applicator.

Another significant advantage of the subject invention is the provision of an insulated, water impermeable roofing system which is substantially lighter in weight than previously known systems. Moreover, the subject factory assembled panels are readily installed and reduce the overall square foot load bearing requirements of the underlying roofing deck.

Because it is not necessary to apply the insulation panels into a hot bituminous coating, a wide variety of insulation materials may be utilized such as polyurethane foams which provide a maximum degree of thermal gradient control.

Further, because the subject factory assembled roofing panels do not require application of a plurality of courses of felt and hot bitumen and also do not utilize loose gravel upon the outer surface thereof, it is possible to specify the subject insulated, water impermeable roofing system for a wide variety of deck materials even with a high degree of deck pitch.

When the optional outer protective layer is utilized, it will be appreciated that the smooth surface thereof is highly reflective and provides a rigid wear layer which may be easily traversed by wheeled equipment and the like.

Still further with the expansion zones filled with a plastic composition, it is possible to accomodate thermal expansion and contraction of the individual panels which is prevelant due to the wide thermal cycling at the exterior roof surface. Still further, the subject roofing system is highly economical to install and maintain when compared to previously known insulated roof membrane assemblies.

In describing the invention, reference has been made to a preferred embodiment. Those skilled in the art, however, and familiar with the disclosure of the subject invention, may recognize additions, deletions, substitutions, modifications and/or other changes which will fall within the purview of the invention as defined in the following claims.

What is claimed is:

1. An insulated, water impermeable, roofing system for insulating the interior of a building from ambient thermal cycling and for insuring water impermeable integrity of a roof portion of the building, said roofing system comprising:

an array of factory assembled, laminar roofing panels self bonded to a roof deck, said panels each including, a water and vapor impermeable membrane, said membrane being plastic and self-adherent under normal ambient temperature conditions, wherein one surface of said membrane is self bonded to said roof deck, and an insulation course coextensively overlying said water and vapor impermeable membrane and having one surface fixedly bonded to the other surface of said water and vapor impermeable membrane, said insulation course serving to isolate the water and vapor impermeable membrane as well as the interior of the building from ambient thermal cycling;

said laminar roofing panels being mutually juxtaposed but laterally spaced from one another to provide a peripheral expansion zone around each panel; and a water and vapor impermeable compound injected into said peripheral expansion zone around each laminar roofing panel, said compound being plastic and self-adherent under normal ambient temperatures and being bonded to the roof deck between adjacent laminar roofing panels, as well as the water and vapor impermeable membrane and insulation layers of each roofing panel, to form a water and vapor impermeable barrier across the entire roof deck and concomitantly to form a plastic expansion joint about the peripheral edges of each of said laminar roofing panels.

2. An insulated, water impermeable, roofing system for insulating the interior of a building from ambient thermal cycling and for insuring water impermeable integrity of a roof portion of the building as defined in claim 1 wherein:

the vapor permeability of said insulation course coextensively overlying said plastic and self-adherent membrane is greater than the vapor permeability of said plastic and self-adherent membrane.

3. An insulated, water impermeable, roofing system for insulating the interior of a building from ambient thermal cycling and for insuring water impermeable integrity of a roof portion of the building as defined in claim 1 and further comprising:

a protective course coextensively overlying and bonded directly to the other surface of said insulation course, said protective course being resistant to ultra-violet, ozone, temperature and wind degradation and further being substantially water impermeable.

4. An insulated, water impermeable roofing system for insulating the interior of a building from ambient thermal cycling and for insuring water impermeable integrity of a roof portion of the building as defined in claim 3 wherein:

the vapor permeability of said insulation course is greater than the vapor permeability of said plastic and self-adhering membrane, and the vapor permeability of said protective course is greater than the vapor permeability of said insulation course, whereby water vapor trapped within the roofing system may escape therefrom into the atmosphere through the laminar roofing system in the direction of increasing vapor permeability.

5. An insulated, water impermeable roofing system for insulating the interior of a building from ambient thermal cycling and for insuring water impermeable integrity of a roof portion of the building as defined in claim 3 wherein said protective course comprises:

a fiber glass reinforced cement containing an acrylic polymer emulsion additive.

6. An insulated, water impermeable roofing system for insulating the interior of a building from ambient thermal cycling and for insuring water impermeable integrity of a roof portion of the building as defined in claim 1 wherein:

said water and vapor impermeable compound is injected into said peripheral expansion zones at least to the upper surface of said insulation course to provide a roofing system with a generally planar upper surface to facilitate water shredding, personnel and equipment mobility upon the roof surface and to minimize the possibility of water degradation of the laminated roofing panel insulation course by seepage through the lateral surfaces thereof.

7. An insulated, water impermeable roofing system for insulating the interior of a building from ambient thermal cycling and for insuring water impermeable integrity of a roof portion of the building as defined in claim 1 wherein:

said water and vapor impermeable membrane comprises a petroleum based, bituminous resin, plasticized with high molecular weight polymeric additives; and said insulation course comprises a polyurethane expanded foam.

8. An insulated, water impermeable, roofing system for insulating the interior of a building from ambient thermal cycling and for insuring water impermeable integrity of a roof portion of the building, said roofing system comprising:

a water and vapor impermeable membrane, wherein one surface of said membrane is self bonding to said roof deck;

an array of factory assembled roofing panels fixedly bonded to the outer surface of said water and vapor impermeable membrane, said panels including an insulation course overlying said water and vapor impermeable membrane, said insulation course serving to isolate the water and vapor impermeable membrane as well as the interior of the building from ambient thermal cycling;

a protective course coextensively overlying an outer surface of said insulation course, said protective course being resistant to ultra-violet, ozone, temperature and wind degradation and further being substantially water impermeable;

said roofing panels being mutually juxtaposed but laterally spaced from one another to provide a peripheral expansion zone around each panel; and a water and vapor impermeable compound injected into said peripheral expansion zone around each roofing panel, said compound being bonded to the water and vapor impermeable membrane and the peripheral edges of said roofing panels to form a water and vapor impermeable barrier across a roof portion of a building and concomitantly to form an expansion joint about the peripheral edges of each of said roofing panels.

9. An insulated, water impermeable roofing system for insulating the interior of a building from ambient thermal cycling and for insuring water impermeable integrity of a roof portion of the building as defined in claim 8 wherein:

the vapor permeability of said insulation course is greater than the vapor permeability of said water and vapor impermeable membrane, and the vapor permeability of said protective course is greater than the vapor permebility of said insulation course, whereby water vapor trapped within the roofing system may escape therefrom into the atmosphere through the laminar roofing system in the direction of increasing vapor permeability.

10. An insulated, water impermeable roofing system for insulating the interior of a building from ambient thermal cycling and for insuring water impermeable integrity of a roof portion of the building as defined in claim 8 wherein said factory assembled roofing panels further comprise:

a water and vapor impermeable sheet bonded directly to an inner surface of said insulation course.

11. An insulated, water impermeable roofing system for insulating the interior of a building from ambient thermal cycling and for insuring water mpermeable integrity of a roof portion of the building as defined in claim 10 wherin:

said water and vapor impermeable membrane, said water and vapor impermeable compound and said water and vapor impermeable sheet, each comprises an elastomeric polyurethane; and said insulation course comprises a polystyrene expanded foam.

* * * * *